US007833019B2

(12) United States Patent
Wallace et al.

(10) Patent No.: US 7,833,019 B2
(45) Date of Patent: Nov. 16, 2010

(54) SPRING BEAM WAFER CONNECTOR

(75) Inventors: Andrew Wallace, Cambridge, MA (US); Michael Kelly, Burlington, MA (US)

(73) Assignee: Methode Electronics, Inc., Chicago, IL (US)

( * ) Notice: Subject to any disclaimer, the term of this patent is extended or adjusted under 35 U.S.C. 154(b) by 0 days.

(21) Appl. No.: 12/011,103

(22) Filed: Jan. 24, 2008

(65) Prior Publication Data

US 2008/0293307 A1 Nov. 27, 2008

Related U.S. Application Data

(60) Provisional application No. 60/931,642, filed on May 24, 2007.

(51) Int. Cl.
*H01R 12/00* (2006.01)

(52) U.S. Cl. ..... 439/66

(58) Field of Classification Search ..... 439/66, 439/71, 591, 592, 70

See application file for complete search history.

(56) References Cited

U.S. PATENT DOCUMENTS 3,530,422 A 9/1970 Goodman
3,665,370 A 5/1972 Hartmann
4,227,767 A * 10/1980 Mouissie ..... 439/493
4,462,657 A 7/1984 Snowdon et al.
4,810,213 A 3/1989 Chabot
4,927,369 A 5/1990 Grabbe
5,030,109 A 7/1991 Dery
5,061,191 A 10/1991 Casciotti et al.
5,088,942 A 2/1992 Welsh
5,092,781 A 3/1992 Casciotti et al.
5,094,636 A 3/1992 Zinn
5,232,372 A 8/1993 Bradley (Continued)

FOREIGN PATENT DOCUMENTS

FR 465535 A 4/1914

(Continued)

OTHER PUBLICATIONS

International Search Report and Written Opinion from International Patent Application No. PCT/US2009/032033 (2009).

(Continued)

*Primary Examiner*—Phuong K Dinh
(74) *Attorney, Agent, or Firm*—Barnes & Thomburg LLP

(57) ABSTRACT

A multi-contact electrical connector wafer includes an insulating base and at least one bay on a first side of the base. A conductor is associated with the at least one bay and the conductor is adapted to contact a corresponding mating element. The wafer further includes a loading beam adapted to bias the first conductor toward the corresponding mating element upon deflection of the beam. A connector may be formed with a conductive component disposed in a connector housing defining a receptacle opening. The conductive component is arranged in the housing in a manner to allow the conductive component to move relative to the housing. As such, the connector can accommodate a mating connector of a first thickness or a mating connector of a second, different thickness. The connector may also be adapted to accommodate a mating connector that is inserted into the receptacle in a manner that is not collinear with respect to the receptacle.

24 Claims, 10 Drawing Sheets

U.S. PATENT DOCUMENTS

| | | | | |
|---|---|---|---|---|
| 5,273,438 | A | 12/1993 | Bradley et al. | |
| 5,297,968 | A | 3/1994 | Johnson et al. | |
| 5,634,801 | A * | 6/1997 | Johnson | 439/71 |
| 5,667,413 | A | 9/1997 | Trafton | |
| 5,730,628 | A | 3/1998 | Hawkins | |
| 5,913,687 | A | 6/1999 | Rathburn | |
| 6,062,919 | A | 5/2000 | Trafton | |
| 6,102,746 | A | 8/2000 | Nania et al. | |
| 6,206,713 | B1 | 3/2001 | Baertsoen | |
| 6,250,974 | B1 | 6/2001 | Kerek | |
| 6,264,508 | B1 | 7/2001 | Lehmann | |
| 6,313,523 | B1 | 11/2001 | Morris | |
| 6,439,894 | B1 | 8/2002 | Li | |
| 6,447,317 | B1 | 9/2002 | Billman | |
| 6,471,555 | B2 | 10/2002 | Creze | |
| 6,659,778 | B2 | 12/2003 | Li | |
| 6,666,690 | B2 | 12/2003 | Ishizuka | |
| 6,695,633 | B2 | 2/2004 | Longueville et al. | |
| 6,805,594 | B2 | 10/2004 | LaCoy | |
| 6,942,496 | B2 | 9/2005 | Sweetland et al. | |
| 6,945,790 | B2 | 9/2005 | Sweetland | |
| 6,951,465 | B2 | 10/2005 | Sweetland | |
| 6,958,616 | B1 | 10/2005 | Mahoney | |
| 6,971,927 | B2 | 12/2005 | Anbo et al. | |
| 7,021,957 | B2 | 4/2006 | Sweetland et al. | |
| 7,056,139 | B2 | 6/2006 | Sweetland | |
| 7,070,419 | B2 | 7/2006 | Brown et al. | |
| 7,077,573 | B2 | 7/2006 | Suh et al. | |
| 7,077,662 | B2 | 7/2006 | Sweetland et al. | |
| 7,083,427 | B2 | 8/2006 | Sweetland et al. | |
| 7,094,064 | B2 | 8/2006 | Sweetland et al. | |
| 7,097,495 | B2 | 8/2006 | Sweetland | |
| 7,101,194 | B2 | 9/2006 | Sweetland et al. | |
| 7,125,281 | B2 | 10/2006 | Sweetland | |
| 7,140,916 | B2 | 11/2006 | Sweetland | |
| 7,458,827 | B2 | 1/2007 | Sweetland | |
| 7,214,106 | B2 | 5/2007 | Sweetland | |
| 7,223,111 | B2 | 5/2007 | Sweetland | |
| 7,311,566 | B2 | 12/2007 | Dent | |
| 7,547,215 | B1 | 6/2009 | Mark | |
| 2003/0003784 | A1 | 1/2003 | Neidich | |
| 2003/0174949 | A1 | 9/2003 | Bhardwaj et al. | |
| 2004/0002234 | A1 | 1/2004 | Masao | |
| 2004/0214454 | A1 | 10/2004 | Sweetland et al. | |
| 2006/0134943 | A1 | 6/2006 | Sweetland et al. | |
| 2008/0293307 | A1 | 11/2008 | Wallace et al. | |
| 2008/0293308 | A1 | 11/2008 | Mark | |
| 2009/0197476 | A1 | 8/2009 | Wallace | |
| 2009/0197481 | A1 | 8/2009 | Mark et al. | |
| 2009/0197482 | A1 | 8/2009 | Mark et al. | |

FOREIGN PATENT DOCUMENTS

| | | | |
|---|---|---|---|
| JP | 10012777 | A | 1/1998 |
| WO | 2004/036697 | A1 | 4/2004 |
| WO | 2005/001998 | A2 | 1/2005 |
| WO | 2008/153764 | A2 | 12/2008 |

OTHER PUBLICATIONS

International Search Report and Written Opinion from International Patent Application No. PCT/US2009/031970 (2009).
International Search Report and Written Opinion from International Patent Application No. PCT/US2009/032036 (2009).

* cited by examiner

P = Wafer Preload = # of contacts x ideal force

Easier Insertion
than Extraction

Equal Insertion
& Extraction F

SPRING BEAM WAFER CONNECTOR

CROSS REFERENCE TO RELATED APPLICATION

This application claims the benefit of U.S. Provisional Patent Application Ser. No. 60/931,642 filed May 24, 2007, which is hereby incorporated by reference in its entirety.

BACKGROUND

1. Field

Aspects of the invention relate to electrical connectors and more particularly to arrangements for providing a contact force in an electrical connector.

2. Discussion of Related Art

Electrical connectors are used to provide a separable path for electric current to flow between components of an electrical system. In many applications, numerous connections between components can, in turn, require numerous signal and/or power connections within a given electrical connector. Lately, there has been an increase in the number of connections required for typical electronic components, which in turn has created a demand for greater numbers of electrical connections in electrical connectors. There has also been a general reduction in the size of electronic components, which has created demand for smaller electrical connectors. For either of these reasons, there is a need for electrical connectors with increased current density, where "current density" refers to the amount of current passed through a given connector divided by the area of the connector. Some of these electrical connectors are required to handle as much as 5 to 20 amps per connection within the connector. Existing technologies cannot meet these requirements while also providing reliable electrical connections.

The applicant also appreciates that in many applications, particularly those involving small conductors, it can be desirable to maximize the contact area between a conductor and a mating element. Connectors with conductors that make contact over a larger area or that produce multiple contact points per connection can often support greater amounts of current flowing through the connector, and in doing so can provide connectors that can support an increased current density.

Greater contact forces can provide for a more reliable electrical connection by preventing separation of the conductor and mating element. Additionally, higher normal contact forces can cause wiping action between the conductor and the mating element when they are engaged in a sliding manner. This wiping action can help remove debris that might be on the conductor or mating element, which might otherwise reduce the reliability of the connection. Wiping action can also help break oxide layers that can limit conductivity. However, there can be drawbacks to high normal contact forces. Higher contact forces can substantially increase the insertion force required to engage the connector with the mating surface. An operator, attempting to overcome such high insertion forces, may damage the connector. Additionally, the wiping action associated with higher contact forces can cause wear of the conductor and/or mating surface, including removal of desirable platings, which can lead to oxidation and poor electrical connections.

Electrical connectors are known to use conductors that are displaced under an elastic load during engagement with a mating surface to provide contact forces. However, applicant appreciates that requiring the conductor to be optimized for both transmitting a current and applying a contact force in this manner often requires compromises to be made when choosing materials or configurations for conductors. By way of example, applicant appreciates that high conductivity copper alloys, which have desirable electrical properties, are avoided for use in electrical connectors because of stress relaxation and creep that may occur over time, repeated use or elevated temperature. High conductivity copper alloy, as the term is used herein, refers to alloys that have at least 90% of the conductivity of metals made of 99.99% copper. It should be appreciated that, as used herein, the term "high conductivity copper" also means pure copper. Attempts to improve the mechanical properties of copper with small quantities of alloying agent, such as 0.5% Beryllium, can reduce the conductivity of the alloy to as low as 20% of the conductivity of pure copper.

SUMMARY

In one aspect, a multi-contact electrical connector wafer is provided. The wafer includes an insulating base and at least one bay on a first side of the base. A conductor is associated with the at least one bay. The conductor of the at least one bay is adapted to contact a corresponding mating element. The wafer further includes a loading beam adapted to bias the first conductor toward the corresponding mating element upon deflection of the beam.

In another aspect, a multi-contact electrical connector is provided. The connector includes a housing defining a receptacle opening and at least one connector wafer disposed in the housing and arranged to contact a mating connector when placed in the receptacle. The at least one connector wafer is arranged in the housing in a manner to allow the at least one wafer to move relative to the housing.

Various embodiments of the present invention provide certain advantages. Not all embodiments of the invention share the same advantages and those that do may not share them under all circumstances.

Further features and advantages of the present invention, as well as the structure of various embodiments of the present invention are described in detail below.

BRIEF DESCRIPTION OF DRAWINGS

The accompanying drawings are not intended to be drawn to scale. In the drawings, similar features are represented by like reference numerals. For clarity, not every component is labeled in every drawing. In the drawings.

DETAILED DESCRIPTION

Electrical connectors of the present invention(s) are adapted to provide an electrical connection to mating elements of a mating connector at an increased current density and/or of a higher mechanical reliability. It should also be appreciated that electrical connector of the present invention (s) is adapted to provide mating connections with a relatively low insertion force. Embodiments of the connector have connector wafers with at least one bay having at least one conductor included in the bay to make electrical contact with corresponding mating element(s). In one embodiment, a loading beam in the connector wafer provides a contact force between the conductor and the mating element when the mating connector is connected to the connector wafer.

In some illustrative embodiments of the invention, the connector wafer has a plurality of bays in an insulating base of the connector wafer. One or more conductors that can conform to a surface of the mating element are a part of each of the bays. One or more loading beams are positioned such that when the mating connector engages the conductor, the loading beams are deflected and, in turn, provide contact forces substantially normal to the conductors and the mating connector. In one embodiment, each wafer includes multiple bays.

In one aspect, electrical connectors may be formed to include a housing defining a receptacle opening and at least one conductive component is disposed in the housing and arranged to contact a mating connector when placed in the receptacle. The connector conductive component is arranged in the housing in a manner to allow the conductive component to move relative to the housing to accommodate mating connectors of varying thicknesses and/or of varying insertion angles inserted into the receptacle. The conductive component is constructed and arranged to impart a desired contact force on the mating connector and is adapted to move within the housing to accommodate the mating connector when the contact force on the conductive component exceeds a threshold force. In one embodiment, the conductive component is adapted to pivot relative to the housing. In one embodiment, multiple conductive components are disposed in the housing. In one embodiment, the conductive component is a wafer, as will be described below.

Figure 1:
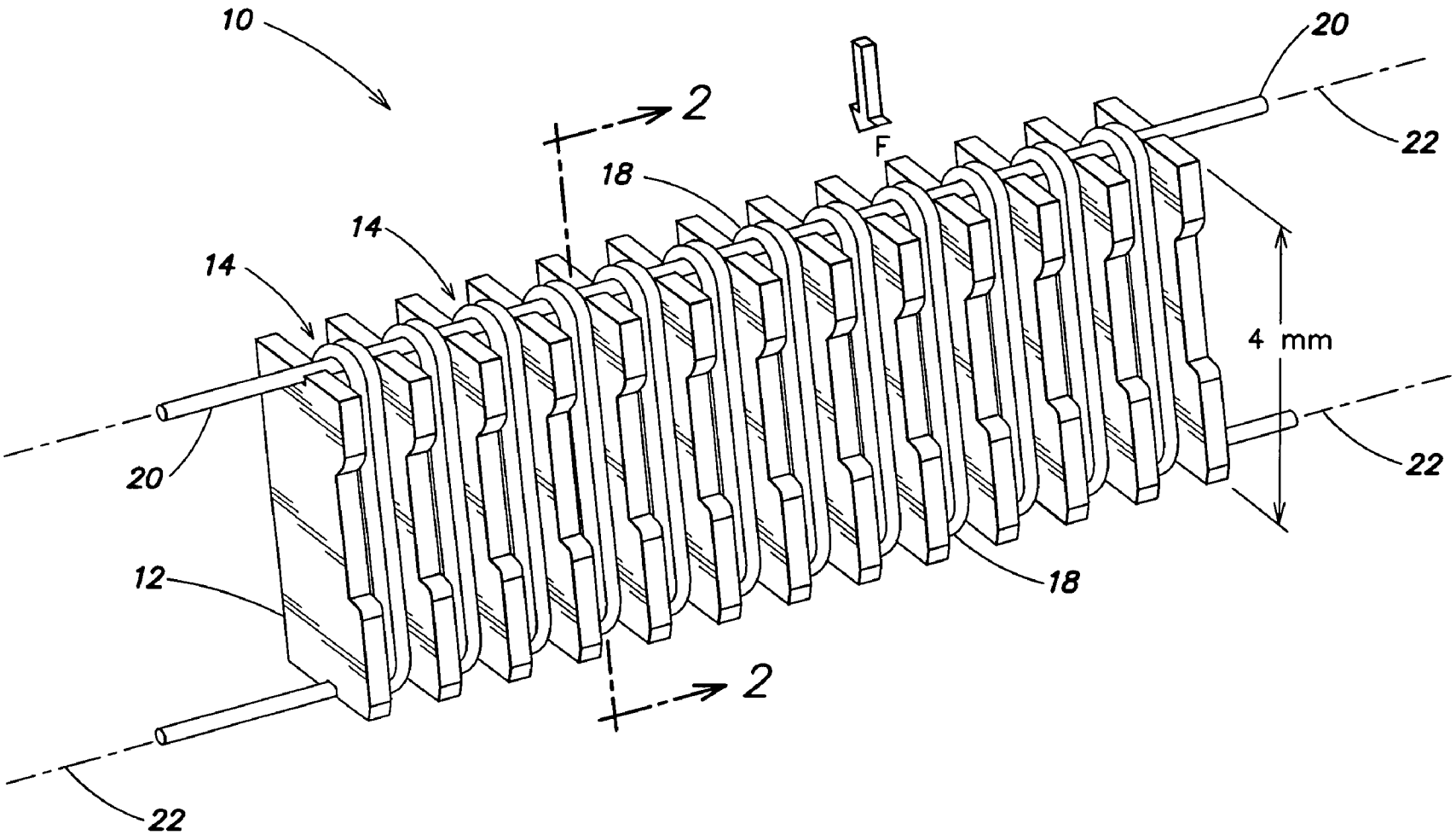
FIG. 1 is a perspective view of one embodiment of an electrical connector showing a connector wafer.

Turning now to the figures, and initially FIG. 1, a schematic representation of a connector wafer 10 is shown. The illustrated connector wafer has a base 12, having a height of approximately 4 mm, that defines a row of bays 14. In the illustrated embodiment, the base is electrically insulative, but can be conductive in other embodiments. Conductors 18 extend around each bay 14 and are positioned to make contact with mating elements when coupled thereto. The conductors may be wrapped around the base once or a plurality of times as desired. In the illustrative embodiment shown, the conductors are wrapped twice around the base in each bay. In one embodiment, the conductors are continuous filaments such that after being wrapped around twice in a bay, the filament traverses the base between two bays and is then wrapped twice around the base again in the adjacent bay. Of course, the present invention is not limited in this regard and each bay may comprise a discrete conductor.

Although the wafer is shown and described as having multiple bays, the wafer may include only one bay, as the present invention is not limited in this respect.

A loading element or beam 20, which may also be referred to as a spring beam, is disposed between the base and the conductor. The beam is formed as a spring element to bias the conductor outward from the base upon the application of a compression force on the conductor. For example, when a contact force F (shown as arrow F in FIG. 1) is applied on the conductor, the spring beam resists the applied bending force and biases the conductor toward the mating connector.

The spring beam 20 may be held relative to the base in a substantially tension free manner. In this regard, substantially no axial tensile force is applied to the beam along axis 22. However, any suitable arrangement may be employed to hold the beam in place so that it does not become dislodged from the connector wafer. In this regard, the conductors may be wound around the loading beam in a manner to prevent it from being dislodged.

The loading beam may be placed on the base prior to winding the conductor or it may be threaded beneath the conductor after the conductor is wound on the base, as the present invention is not limited in this respect.

Embodiments of the electrical connector allow materials with optimal electrical characteristics to be used as conductors, and materials with optimal mechanical characteristics to provide contact forces between the conductors and mating elements. Although the conductors of the electrical connector may move and/or flex when the connector is engaged with a mating element, they are not required to generate the contact force in many embodiments—thus allowing the conductors to be chosen primarily for electrical properties instead of a combination of electrical and mechanical properties. Similarly, the loading beams provide a mechanical contact force between the conductors and the mating elements. In this regard, the loading beams can be chosen primarily for their mechanical characteristics.

In many embodiments, the mechanical properties of individual conductors do not contribute significantly to the associated contact force of the conductor. However, in other illustrative embodiments, the forces associated with moving individual conductors within a connector can contribute to the contact force, even substantially, as aspects of the invention are not limited in this respect.

As discussed herein, constructing the connector with a loading beam to provide contact forces, instead of having the conductors themselves provide the contact force, allows the conductors to be made of a material that has optimal electrical properties. By way of example, high conductivity copper alloys can be used in embodiments of the present invention without concerns of the material being unable to provide an adequate contact force over time or after repeated cycles of dis-engagement and re-engagement. However, it is to be appreciated that embodiments of the present invention are not limited to having conductors made of high conductivity copper alloys, and that other conductive materials, such as copper, platinum, lead, tin, aluminum, silver, carbon, gold, or any combination or alloy thereof, and the like, may be suitable as well.

Figure 2C:
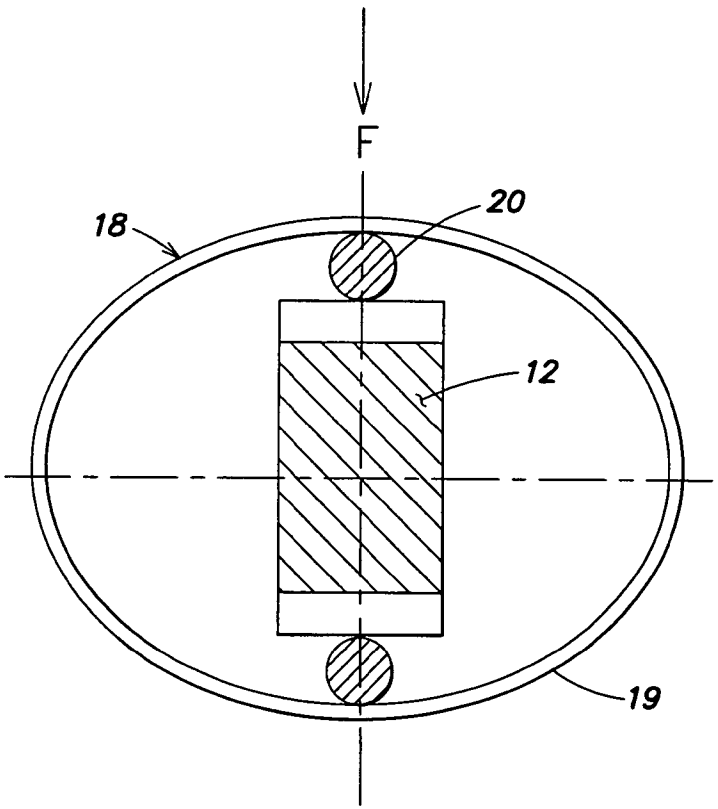
FIGS. 2*a*-2*c* are schematic representations of alternative embodiments of a cross-section of the connector wafer taken along line 2-2 of FIG. 1.
Figure 2B:
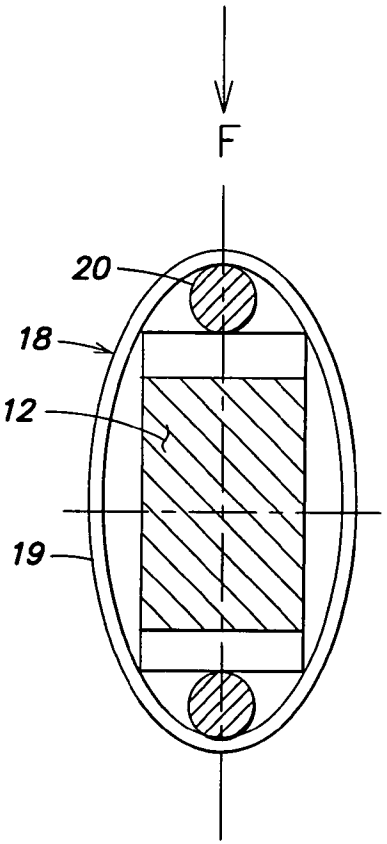
Figure 2A:
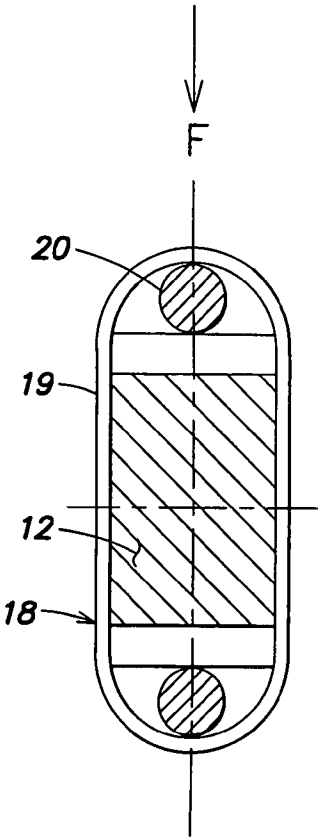

Turning now to FIGS. 2*a*, 2*b* and 2*c*, alternative embodiments for winding the conductors around the base is shown. In FIG. 2*a*, the conductor is wound relatively tightly around the base and the loading beam. In the embodiment shown in FIG. 2*a*, the side portions 19 of the conductor that extend along in the direction of the longitudinal axis may contribute to the normal force acting on the mating connector as the conductor compresses in the longitudinal direction. To reduce the effect of the conductor itself providing a normal force against the mating connector, in one embodiment, as shown in FIG. 2*b*, the conductor is wound relatively more loosely around the base so that as the force F is applied along the longitudinal direction, the side portions 19 of the conductor are allowed to bend. FIG. 2*c* represents a further modification in which the conductors are wound even more loosely around the base. In this embodiment, almost no force from the conductors in the direction of the longitudinal axis L is provided, and when the force from the mating connector is applied, the side portions of the conductor simply bend.

Figure 3A:
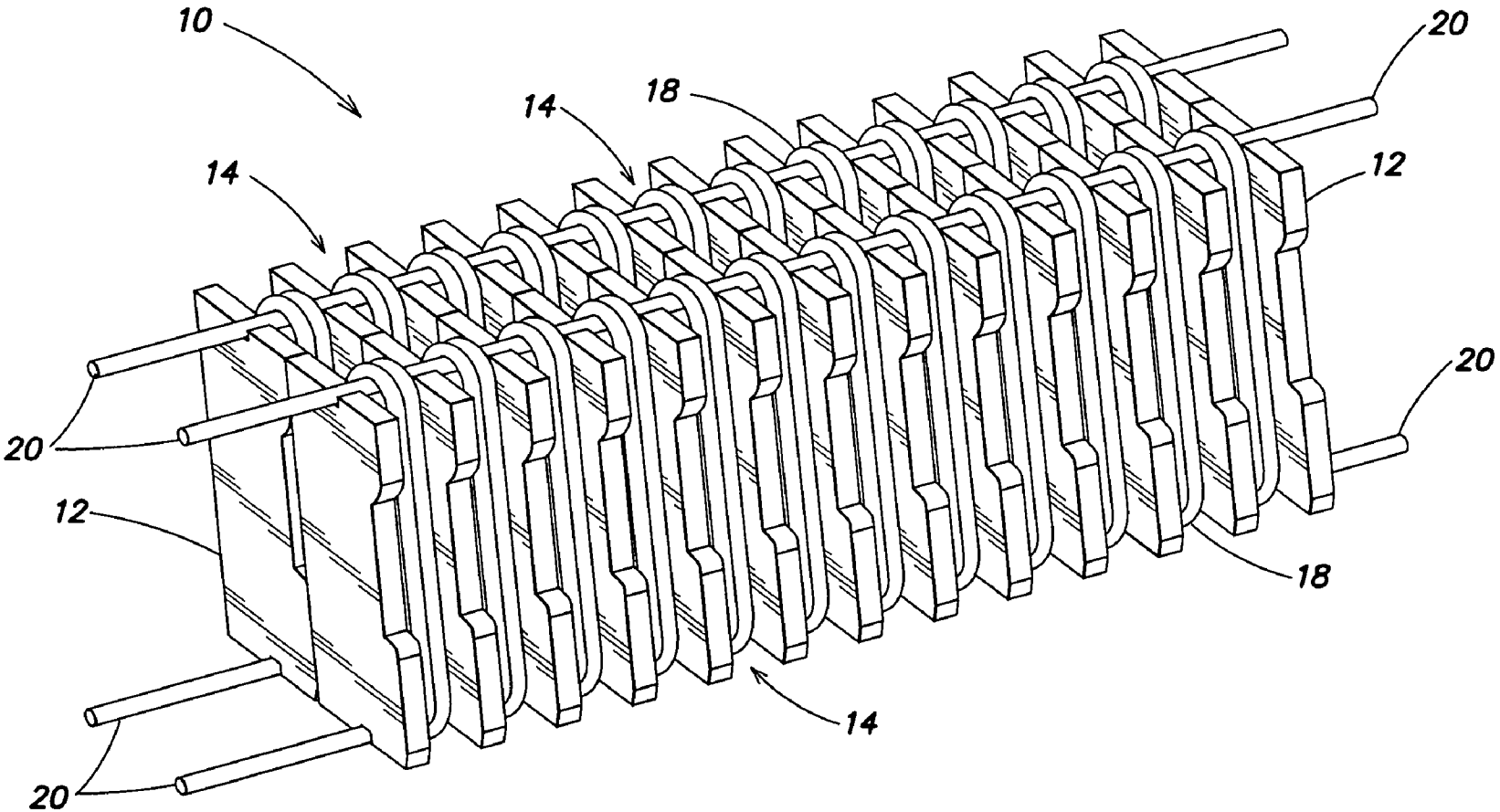
FIGS. 3*a* and 3*b* are perspective views of alternative arrangements of multiple connector wafers.
Figure 3B:
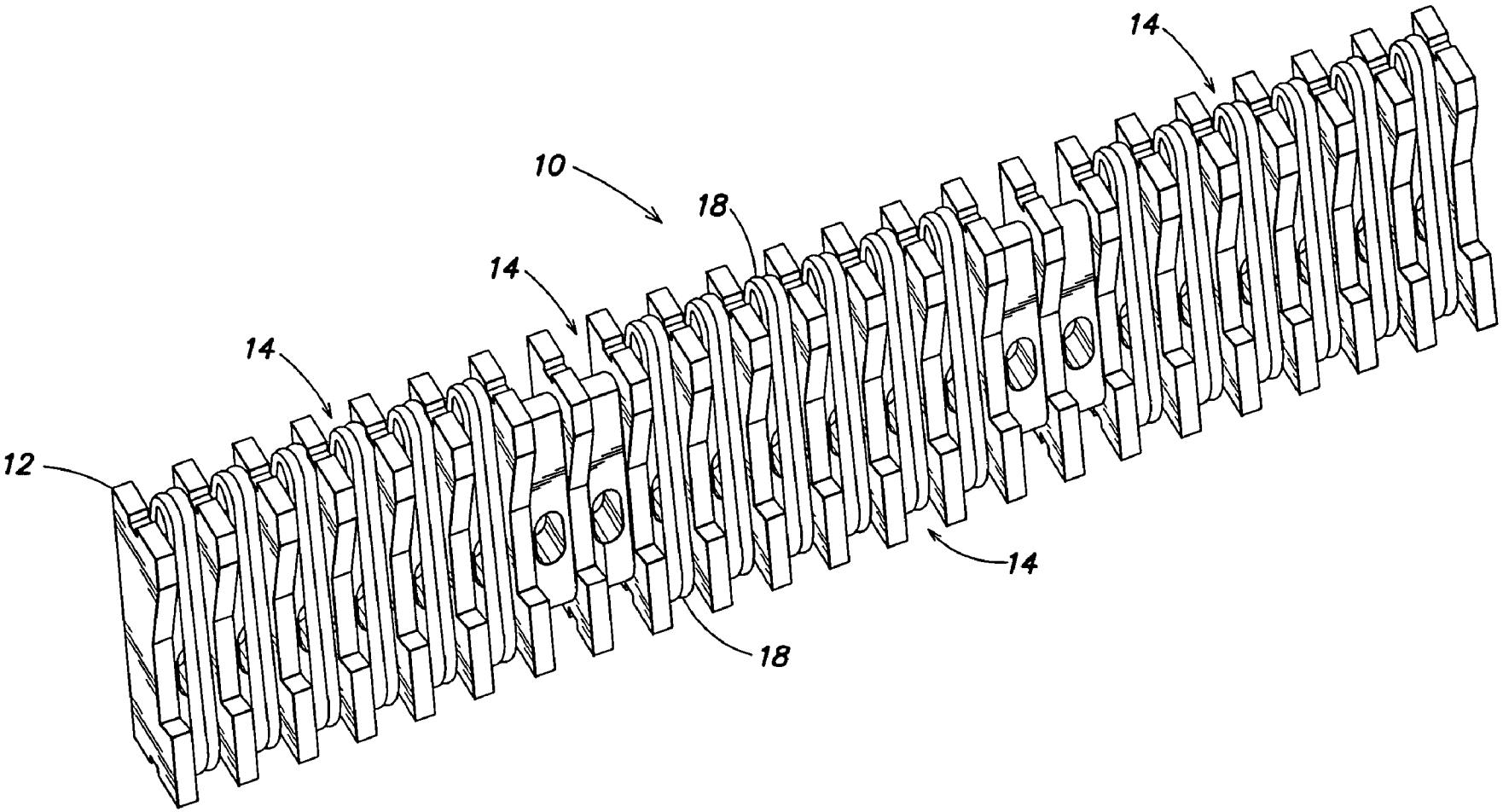

It should be appreciated that the connector wafer may be configured as a single array having a plurality of bays, each receiving one or more windings of a conductor. However, as shown in FIG. 3*a*, two connector wafers are arranged in a side-by-side relationship. Of course, additional connectors may be arranged along the side thereof to create a multi-array connector. Similarly, with respect to FIG. 3*b*, connector wafers may be arranged along a single line to increase the overall length of the connector wafers. It should be appreciated that in FIG. 3*b*, the loading beam has not been shown.

Figure 4:
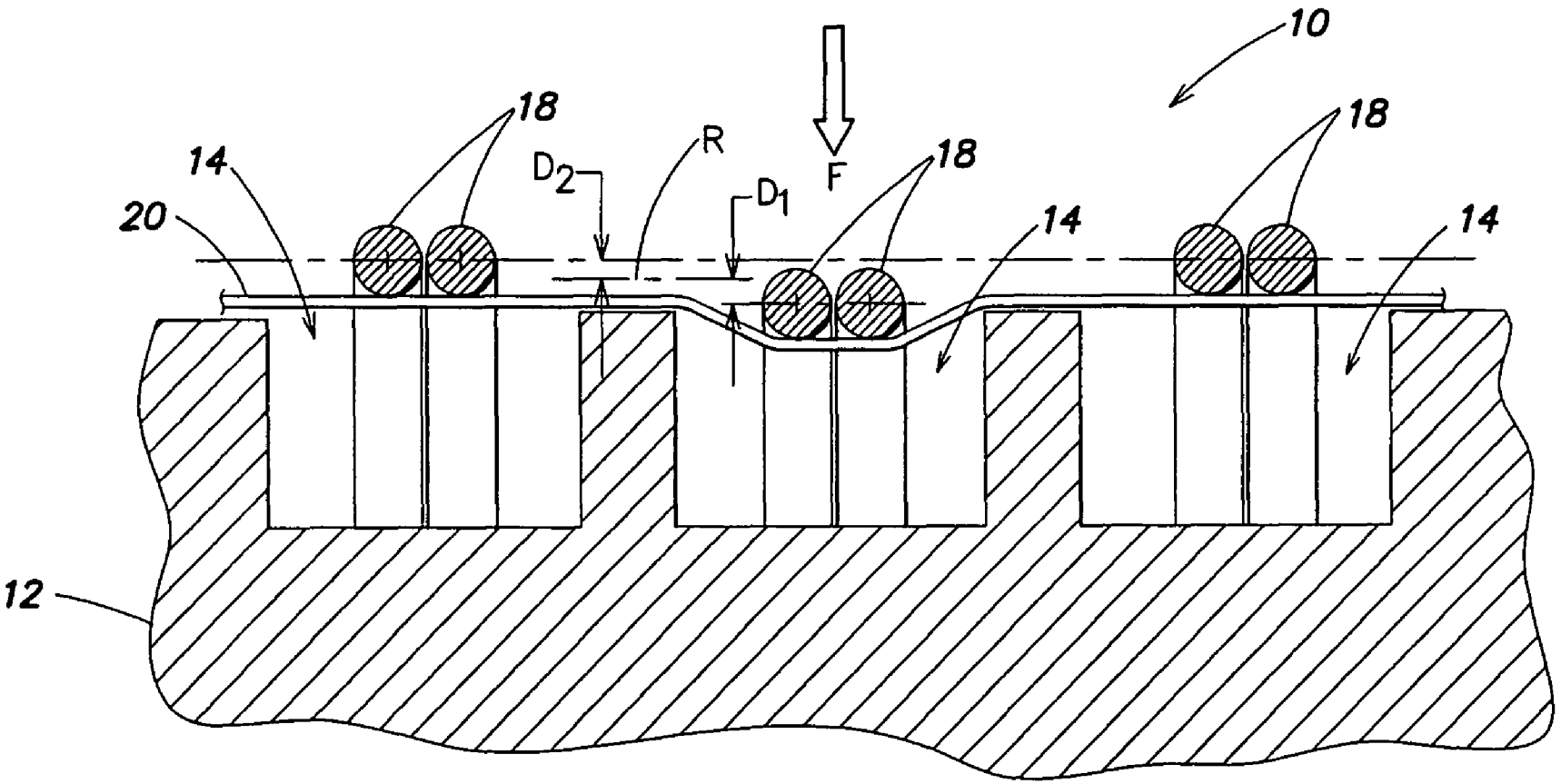
FIG. 4 is a schematic representation of a portion of the connector wafer.

Because the spring beam 20 is a relatively resilient member, the behavior of the spring beam within a bay acts in a manner similar to a beam having a fulcrum on either end of the length of a beam. This feature may be advantageous in certain circumstances. Turning to FIG. 4, a schematic representation of a portion of the connector wafer is shown. As force F is applied to the central conductors in the central bay 14, the conductors are displaced by a distance D1 and are biased by the spring beam 20. The deflection and resilience of the spring beam creates the normal force when the connector is placed adjacent to a mating connector. As can be seen in FIG. 4, the spring beam in the adjacent bays rises above the reference line R by a distance D2. This is due to the bending moment of the spring beam being transferred about the fulcrum to the neighboring bays. This phenomenon extends the functional range of the conducting elements above the reference line R within the adjacent bays. This compliance may enable the contact of many points on a mating surface to accommodate for any irregularities in the mating surface.

As noted above, the spring beam may be formed of any suitable material to provide the required resilience to impart the desired normal force on the mating connector. As mentioned, the loading beam may be formed of stainless steel material. In one embodiment, the loading beam may be formed of a non-conductive material and in some embodiments, such as for a data connector, this may be preferred. Furthermore, the cross-sectional shape of the loading beam may be any desired shape. In one embodiment, the cross-sectional shape is substantially round. In another embodiment, the cross-sectional shape is substantially oval. In yet another embodiment, the cross-sectional shape corresponds to the inside curvature of the conductor as it is wound around the spring beam and the base.

As noted, the purpose of the spring beam is to provide the normal force for the conductors to contact the mating connector. In one embodiment, at a rest state of the connector, the force exerted by the spring beam on the conductors is approximately zero.

Illustrative embodiments of connectors can have different numbers of loading beams to apply contact forces between conductors 18 and the mating connector elements. By way of example, the embodiment of FIG. 1 shows one loading beam 20 that applies a contact force between each of the conductors and corresponding mating elements (not shown). Any number of loading beams 20 can be used to apply contact forces between the conductors and the mating elements, as aspects of the invention are not limited in this regard.

Loading beams can extend along one bay (whether the wafer includes one bay or multiple bays) or along multiple bays in a connector to help increase the current density of a connector. For example, loading beams can extend along an entire row of bays 14 in a connector. In one embodiment, the base 12 of the connector 10 includes a passageway that allows the loading beams to be placed adjacent to each of the bays. The passageway also allows for at least some minimal movement of loading beams 20 along the longitudinal direction of the passageway as the beams are deflected. Although these illustrated embodiments have loading beams that span an entire row of sockets, other embodiments can be configured differently. By way of example, some embodiments can have only a single bay 14. Still, some embodiments with multiple bays can have loading beams that span only a subset of the bays, or that even span only individual bays in the connector wafer, as aspects of the invention are not limited in this manner.

As is to be appreciated, the contact force between the mating element and a conductor can be altered through various techniques. As described herein, the number of loading beams associated with a given mating element and conductor can be increased, which will increase the overall force applied to a mating element. The size and/or stiffness of the loading beam may be changed to alter the spring rate of the beam and thus the contact force imparted on the conductor. Other techniques can be used to change the contact force, as aspects of the invention are not limited to those discussed above.

Loading guides within the connector wafer may be employed and can have features to facilitate movement of the loading beam. In one embodiment, the loading guide is merely the fulcrum area between adjacent bays and is formed of the base 12 itself. In other embodiments, the loading guide may be a distinct element coupled to the base 12. It should be appreciated that any suitable loading guide element may be employed, as the present invention is not limited in this respect. As may be appreciated, the loading beam, in some embodiments may slide relative to the loading guide as the conductor is displaced during engagement with a mating connector. The interface of the loading guide can have features to minimize wear and/or friction with the loading beam. Such features can include rounded edges, resilient materials, and/or low friction materials at the interface. The low friction material can be the material of the base itself, or can include an additional element affixed to the base at the interface. Still, in other embodiments, coatings or lubricants may be applied to the loading beam and/or interface to reduce friction and/or decrease wear. However, the invention is not limited in this respect, and in some embodiments, a certain amount of friction may be desirable. In some connector embodiments, the loading guides can be movable, rather than fixed. Movable loading guides can include elastomeric materials placed between the loading beam and the base. In other embodiments, movable loading guides can include spring loaded elements that move as loading beams are displaced. Movable loading guides can be used in some embodiments to alter the contact forces between the conductors and the mating elements. Still, in some embodiments, loading guides can be used to increase the range of sizes of mating elements that can be connected to. It is to be appreciated that not all embodiments of the invention include such features, as the invention is not limited to the constructions of loading guides described above or to having loading guides at all.

The loading beam may include features that are suited for particular applications. In some illustrative embodiments, the loading beam comprises an electrically conductive material. In this regard, the loading beam can provide an additional pathway for current flow through the connector and between different mating elements present in the connector. Such features may be desirable in some power connector applications. In some embodiments, the loading beam comprises a monofilament having a circular cross section. It should be appreciated that the loading beam is not limited to a particular shape, as any suitable shaped may be employed.

The loading mechanism of the connector, such as the loading beam, may also be chosen with optimal mechanical characteristics in mind—rather than compromising for a mechanism or material that has both appropriate mechanical and electrical properties. As discussed herein, in some applications, the loading beams are not necessarily required to carry an electrical current within the connector. In this regard, the loading beam and any other features of the connector that help provide the contact force, may be chosen based on the mechanical properties of the connector.

Figure 5:
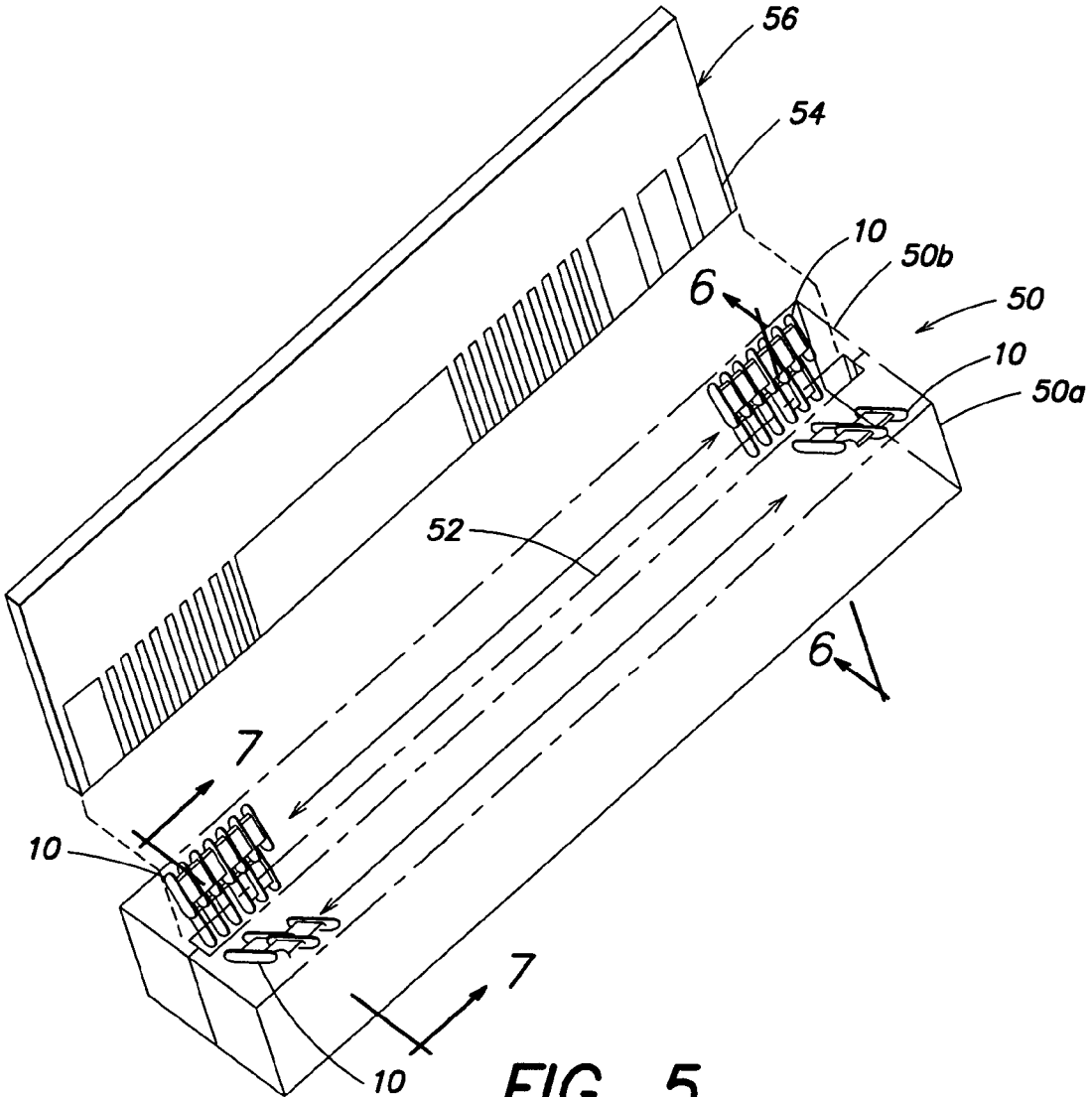
FIG. 5 is a perspective representation of a connector having one or more conductive components arranged in a housing and adapted to receive an exemplary mating connector on a card.

Turning now to FIG. 5, an illustrative embodiment of a connector for receiving a mating connector on a card is shown. The connector 50 in this embodiment is formed with two connector halves 50*a* and 50*b* that together cooperate to define a receptacle 52. The receptacle is sized to receive the electrical connector end 54 of the card 56. As can be seen in FIG. 5, the interior of the receptacle 52 includes the conductors 18 that are adapted to engage the connector portion 54 of the card 56.

The connector 50 includes at least one conductive component 10. In the embodiment shown, however, the connector 50 is formed with a plurality of the connector wafers 10 described above with reference to FIGS. 1-4. However, it should be appreciated that the present invention is not limited in this regard and that any suitable conductive component may be disposed within the housing 50*a*, 50*b* of the connector 50. Further, in embodiments employing wafers, a loading beam need not be employed. In this regard, it is contemplated that other arrangements for imparting a biasing force on the conductors may be employed, as the present invention is not limited in this respect. For example, a loading fiber, such as Kevlar®, may be tensioned at its ends and impart a restorative force on the conductors when the connector is coupled to a mating connector.

Figure 6:
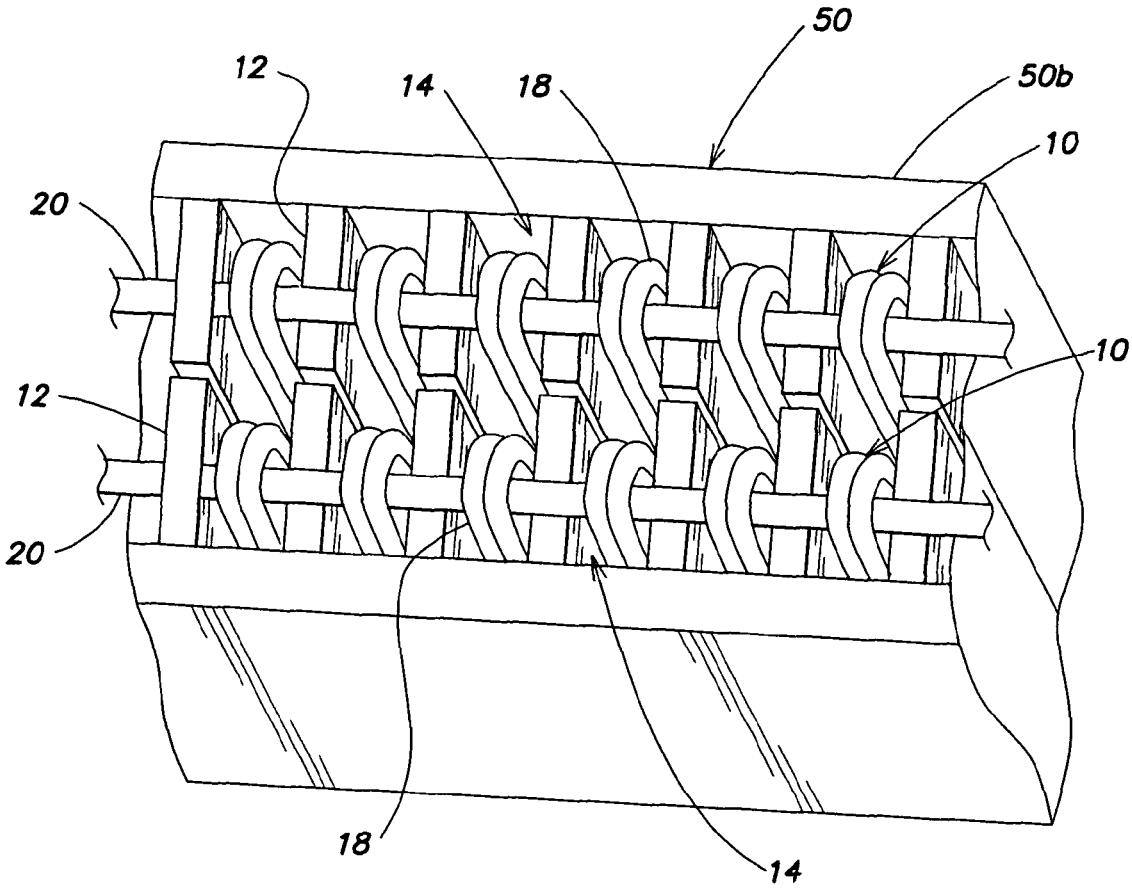
FIG. 6 is an enlarged partial view of a portion of the connector of FIG. 5.

For illustrative purposes only, turning to FIG. 6, an enlarged view of the portion of the connector 50 taken along line 6-6 of FIG. 5 is shown. As can be seen, the connector 50 is formed with side-by-side arrays of connector wafers 10, which, as described above, includes the base 12 with the plurality of conductors 18 wound around the base and a loading beam 20 for providing the normal force for the conductor to mate with the mating connector 54.

As noted above, providing the connector with the ability to accept a mating surface of varying thickness, tolerance and/or angular misalignment, which characteristic is referred to herein as "macro compliance", may be achieved through a unique connector interface, as will now be described.

Figure 7:
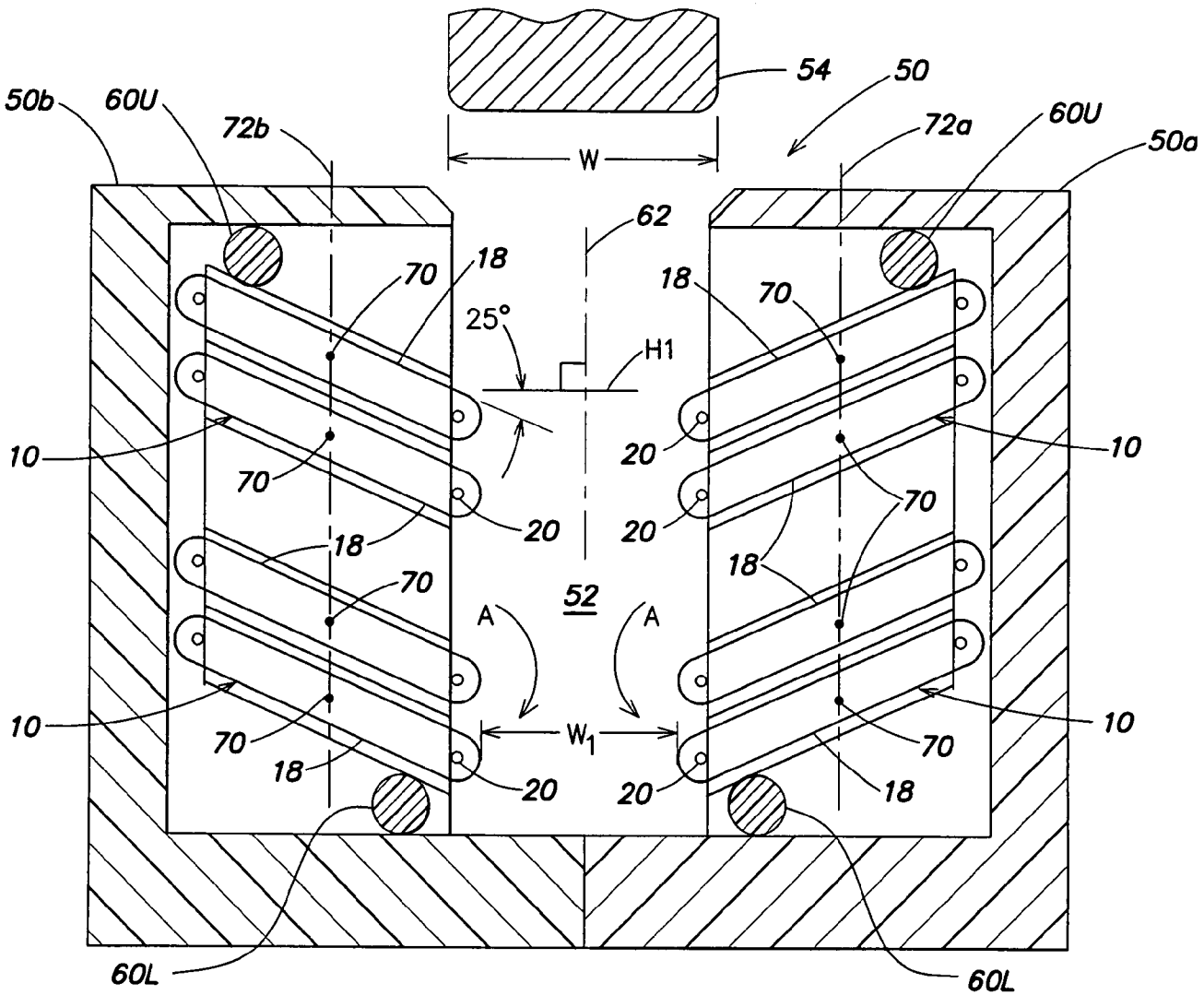
FIG. 7 is a cross-sectional representation of the connector of FIG. 5.

Turning to FIG. 7, the connector 50 comprises housing 50*a* and 50*b* defining the receptacle 52 and includes a plurality of wafers 10 disposed in the housing and arranged to contact the mating connector when it is placed in the receptacle. The individual wafers are arranged in the housing in a manner to allow the wafers to move relative to the housing to accommodate mating connectors of varying thicknesses, tolerances and/or varying insertion angles that are inserted into the receptacle. As can be appreciated in FIG. 7, as the mating connector is inserted into the receptacle 52, it engages and presses against the conductors 18 of the individual wafers 10. However, if the width W of the mating connector is variable or is slightly wider than desired, then an additional force would be applied to the conductors 18. This additional force may damage the wafer and/or may be undesirable to provide good conductivity between the wafers 10 and the mating connector 54. Accordingly, to maintain the same level of contact force yet accommodate the variable thickness in the mating connector, the wafers 10 are adapted to move within the housing. That is, the spacing W1 between the wafers on opposing sides are able to spread apart such that distance W1 between them can be made greater. As such, the connector can accommodate a mating connector of a first thickness or a mating connector of a second, different thickness. The connector may also be adapted to accommodate a mating connector that is inserted into the receptacle in a manner that is not collinear with respect to the receptacle.

In one embodiment, the wafer and housing cooperate to allow the wafers to pivot relative to the housing. In this regard, the wafers are adapted to pivot downward, as shown by arrow A, thereby increasing the width W1. In one embodiment, this pivoting motion is resisted by biasing elements 60 disposed within the housing. The restoring force for the pivoting wafers is, in one embodiment, elastomeric strips 60. Of course, the present invention is not limited in this regard, as other suitable materials may be employed for the restoring force.

In one embodiment, the wafers 10 are adapted to pivot about their respective centers, such as the centers 70 along center lines 72*a*, 72*b*, as depicted in FIG. 7. As such, in order to bias the wafers to their unloaded, rest state, the lower biasing element 60L in the right-side housing 50*a* is disposed toward the left of the center line 72*a*, whereas the upper biasing element 60U in the right-side housing 50*a* is disposed toward the right of the center line 72*a*. In this manner, in the right-side housing 50*a*, the lower wafers are restored by urging the left side of the wafers upward while the upper wafers are restored by urging the right side of the wafers downward. Of course, in the left-side housing 50*b*, the lower biasing element 60L is positioned toward the right of the center line 72*b* whereas the upper biasing element 60U is positioned toward the left of the center line 72*b* such that the lower wafers are restored by urging the right side of the wafers upward while the upper wafers are restored by urging the left side of the wafers downward.

Figure 8:
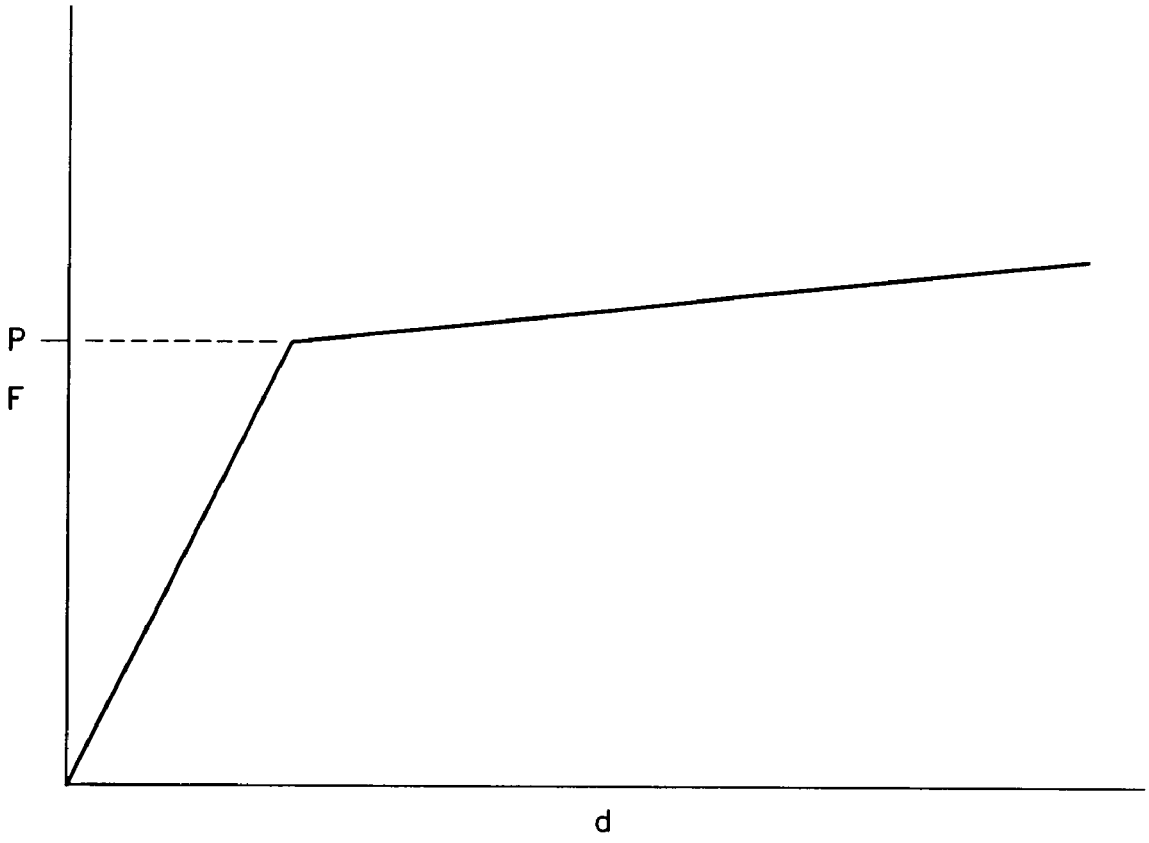
FIG. 8 is a graph of contact force versus deflection of an exemplary connector.

In the embodiment shown, the angle of the wafer relative to a horizontal line H1 that extends substantially perpendicular to the insertion axis 62 is approximately 25 degrees. However, any other suitable angular position may be employed, as the present invention is not limited in this regard. Referring to FIG. 8, a graph of the contact force "F" on the connector wafer 10 versus the displacement "d" of the conductor is shown. In one illustrative embodiment, the force at which the individual wafers 10 pivots away from the mating connector is about equal to the desired force necessary to impart sufficient electrical connection between the wafer 10 and the mating connector. This threshold force is shown at P on the graph of FIG. 8. Thus, should the mating connector be too thick such that it would otherwise impart an undesirable large force on the wafer, the wafer moves within the housing away from the mating surface, thereby increasing the width W1.

Threshold force P may depend upon a variety of factors. In one embodiment, threshold force P is a function of the number of contacts per bay and the desired contact force for each conductor against the mating connector. By way of example, if each conductor is to impart a 2.5 gram force on the mating connector and each bay has a total of 2 conductors and there are 26 bays, then the total force acting on a connector would be 130 grams. In other words, 2.5 grams×2×26=130 grams. As such, the biasing force on the elastomeric biasing element 60 is sized such that the wafers are able to move when the normal force against the connector wafer exceeds 130 grams.

In this way, the connector wafer is able to impart the desired contact force without influence from the connector thickness. It should be appreciated that the forces discussed above are exemplary only and are intended to illustrate relative forces on the connector. In the example given, the threshold force assumes a single wafer.

Figure 9A:
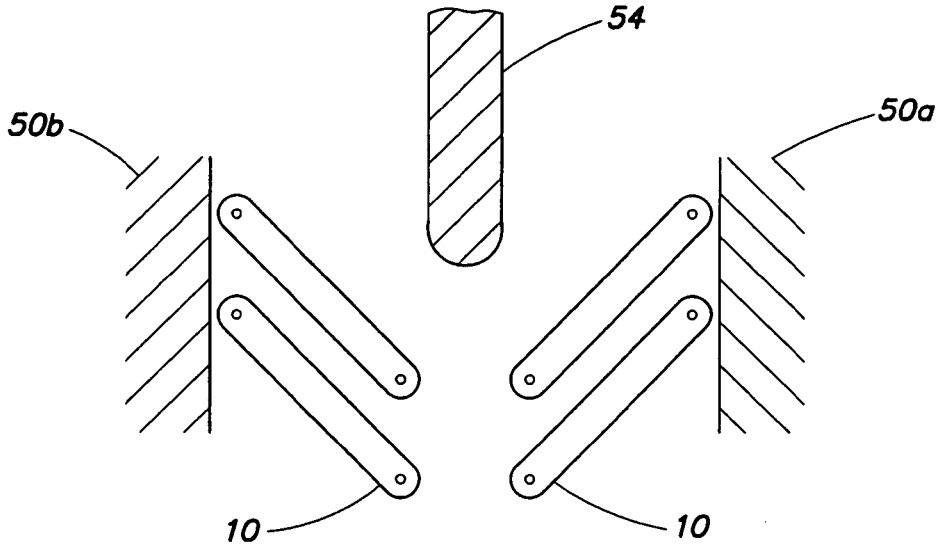
FIGS. 9*a* and 9*b* show alternative arrangements of an angular displacement of the conductive components in the housing.
Figure 9B:
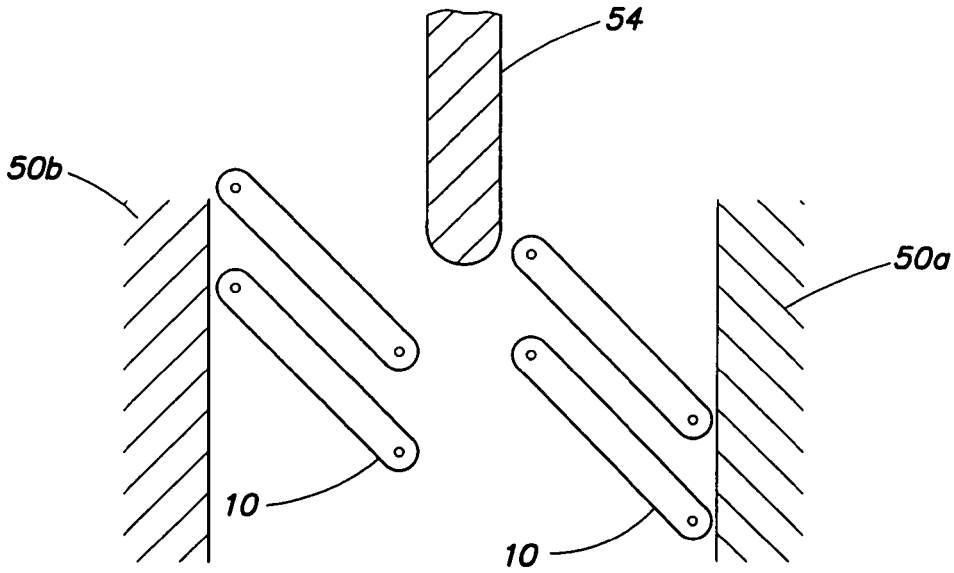

Turning now to FIGS. 9*a* and 9*b*, various arrangements of the wafers within the housing is shown schematically. In FIG. 9*a*, the wafers are arranged such that they funnel downward, as in the connector of FIG. 7, such that the insertion force necessary to place the mating connector into the receptacle is less than the extraction force required to remove the mating connector therefrom. On the other hand, should it be desired that the insertion force be similar to the extraction force, then an arrangement like that shown in FIG. 9*b* may be provided. In this regard, the wafers on one side of the connector housing are angled downward, whereas the connectors on the opposite side of the housing are angled upward.

In the embodiments illustrated in the figures, the mating elements contact the conductors in sliding contact. However, not all embodiments of the invention have conductors engage mating elements in sliding contact. By way of example, some embodiments of the invention can include a base with two halves that are brought together to sandwich one or more mating elements. Still, other arrangements can be configured to engage the mating elements in different manners, as aspects of the invention are not limited in this regard.

It should be appreciated that only one conductive component (e.g. wafer 10) need be employed in the connector housing, as the present invention is not limited in this respect. In this regard, the side opposite a single conductive component can provide a rigid backing to the mating connector. Indeed, any suitable arrangement of a conductive component or components in the housing may be employed, as the present invention is not limited in this respect.

The present invention is not limited to any particular combination and any of the above-noted and/or other features may be used singularly or in any suitable combination. In this regard, the wafer structure including the loading beam described above with reference to FIGS. 1-4 may be employed in a connector housing described above with reference to FIGS. 5-9. However, the invention is not so limited and the wafer structure including the loading beam described above with reference to FIGS. 1-4 may be employed separately from the connector housing described above with reference to FIGS. 5-9 and, similarly, the connector housing described above with reference to FIGS. 5-9 may make use of conductive components other than the wafer structure and/or the loading beam described above with reference to FIGS. 1-4. Further, in embodiments including a wafer within a housing, the wafer need not include a loading band and instead may employ a conductor biasing element. The conductor biasing element may be a tensioned fiber that can impart a restorative force on the conductor when a mating force is applied thereto.

It should also be appreciated that embodiments of the present invention can be adapted for use in a wide variety of applications. Some of the more prevalent applications include power and/or data transmission. A connector housing may include multiple arrays of conductors, in a row or in a grid, each used to transmit power or data, or combinations of arrays used for either purpose. Additionally, conductors within a given array may be connected to a common source conductor, or may be connected to individual source conductors that are used for similar or different purposes. It is to be appreciated that variations, such as those mentioned above, and others, can be made without departing from aspects of the invention.

Embodiments of the invention may be produced using any technique or component (or any suitable combination thereof) described in any of U.S. Pat. Nos. 6,942,496; 7,101,194; 7,021,957; 7,083,427; 6,945,790; 7,077,662; 7,097,495; 7,125,281; 7,094,064; 7,214,106 and 7,056,139—each of which is assigned to the assignee of the present application and each of which is hereby incorporated by reference in its entirety.

Having thus described several aspects of at least one embodiment of this invention, it is to be appreciated various alterations, modifications, and improvements will readily occur to those skilled in the art. Such alterations, modification, and improvements are intended to be part of this disclosure, and are intended to be within the spirit and scope of the invention. Accordingly, the description and drawings herein are by way of example only.

What is claimed is:

1. A multi-contact electrical connector wafer comprising:

an insulating base, the insulating base defining at least a first bay;

a flexible conductor associated with the first bay and wound at least once around a circumference of the insulating base associated with the first bay, the conductor being adapted to contact a corresponding mating element; and a loading beam adapted to bias the conductor toward the corresponding mating element upon deflection of the beam.

2. The connector wafer of claim 1, wherein the at least a first bay comprises a plurality of bays.

3. The connector wafer of claim 1, wherein the loading beam is disposed adjacent the base in a direction transverse to a contact force of the conductor on the mating element.

4. The connector wafer of claim 1, wherein the loading beam is held relative to the base in a tension-free manner.

5. The connector wafer of claim 1, wherein the material of the loading beam is one of stainless steel, Nitinol, and spring steel.

6. The connector wafer of claim 2, wherein contact of the conductor associated with the first bay causes a portion of the beam corresponding to the first bay to deflect in one direction and causes a portion of the beam corresponding to an adjacent bay to deflect in an opposite direction to force an elevation of a conductor associated with the adjacent bay.

7. The connector wafer of claim 1, wherein the loading beam is coated with at least one of PTFE and nickel.

8. The connector wafer of claim 1, wherein the conductor comprises a high conductivity copper alloy.

9. The connector wafer of claim 1, wherein the loading beam has a cross-section that is approximately round.

10. The connector wafer of claim 1, wherein the loading beam has a cross-section that is approximately oval.

11. The connector wafer of claim 2, wherein the flexible conductor is further associated with at least a second bay.

12. The connector wafer of claim 2, wherein a second flexible conductor is associated with at least a second bay.

13. The connector wafer of claim 6 wherein the conductor associated with the first bay and the conductor associated with the adjacent bay are a single conductor.

14. The connector wafer of claim 6 wherein the conductor associated with the first bay and the conductor associated with the adjacent bay are different conductors.

15. A multi-contact electrical connector wafer comprising:

an insulating base, the insulating base defining a plurality of bays, each of the plurality of bays comprising a region defined by a unique pair of end portions and a core coupling the unique pair of end portions, the core being spaced from the periphery of the unique pair of end portions;

a flexible conductor associated with a first of the plurality of bays and wound around the core corresponding to the first of the plurality of bays, the conductor being adapted to contact a corresponding mating element; and a loading beam adapted to bias the conductor toward the corresponding mating element upon deflection of the beam.

16. The connector wafer of claim 15, wherein the loading beam is disposed adjacent the base in a direction transverse to a contact force of the conductor on the mating element.

17. The connector wafer of claim 15, wherein the loading beam is held relative to the base in a tension-free manner.

18. The connector wafer of claim 15, wherein contact of the conductor associated with the first bay causes a portion of the beam corresponding to the first bay to deflect in one direction and causes a portion of the beam corresponding to an adjacent bay to deflect in an opposite direction to force an elevation of a conductor associated with the adjacent bay.

19. The connector wafer of claim 15, wherein the loading beam has a cross-section that is approximately round.

20. The connector wafer of claim 15, wherein the loading beam has a cross-section that is approximately oval.

21. The connector wafer of claim 15, wherein the flexible conductor is further associated with at least a second bay.

22. The connector wafer of claim 15, wherein a second flexible conductor is associated with at least a second bay.

23. The connector wafer of claim 18 wherein the conductor associated with the first bay and the conductor associated with the adjacent bay are a single conductor.

24. The connector wafer of claim 18 wherein the conductor associated with the first bay and the conductor associated with the adjacent bay are different conductors.

* * * * *